US006993110B2

(12) United States Patent
Hoffman

(10) Patent No.: US 6,993,110 B2
(45) Date of Patent: Jan. 31, 2006

(54) COLLIMATOR FOR IMAGING SYSTEMS AND METHODS FOR MAKING SAME

(75) Inventor: David Michael Hoffman, New Berlin, WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 197 days.

(21) Appl. No.: 10/132,833

(22) Filed: Apr. 25, 2002

(65) Prior Publication Data

US 2003/0202633 A1 Oct. 30, 2003

(51) Int. Cl.
*G21K 1/02* (2006.01)

(52) U.S. Cl. ..... 378/19; 378/98.8; 378/149; 250/363.1; 250/370.09; 250/370.11; 264/109; 419/67

(58) Field of Classification Search ..... 378/19, 378/147, 149, 154, 155, 98.8; 250/363.1, 250/505.1, 370.09, 370.11; 264/109; 419/67
See application file for complete search history.

(56) References Cited

U.S. PATENT DOCUMENTS 4,125,776 A * 11/1978 Tosswill et al. ..... 378/149
4,912,077 A * 3/1990 Lachman et al. ..... 502/302
4,973,570 A * 11/1990 Ukawa et al. ..... 502/243
5,391,879 A * 2/1995 Tran et al. ..... 250/367
5,455,849 A * 10/1995 Logan et al. ..... 378/154
5,466,415 A * 11/1995 Brundage et al. ..... 419/67
5,487,865 A * 1/1996 Hampton et al. ..... 419/5
5,757,011 A * 5/1998 Whitebook et al. .... 250/370.09
5,956,382 A * 9/1999 Wiener-Avnear et al. .. 378/98.8
6,005,908 A * 12/1999 Oppelt et al. ..... 378/19
6,041,097 A * 3/2000 Roos et al. ..... 378/62
6,181,773 B1 * 1/2001 Lee et al. ..... 378/155
6,292,529 B1 * 9/2001 Marcovici et al. ..... 378/19
6,365,900 B1 * 4/2002 Mestais et al. ..... 250/363.1
6,415,017 B1 * 7/2002 Kohda ..... 378/154
6,470,072 B1 * 10/2002 Johnson ..... 378/154
6,519,313 B2 * 2/2003 Venkataramani et al. ..... 378/19
6,529,582 B2 * 3/2003 Feldmesser et al. ..... 378/154
6,594,878 B2 * 7/2003 Kohda ..... 29/417
6,716,512 B2 * 4/2004 Yamamoto et al. ..... 428/116
2002/0176538 A1 * 11/2002 Wimberger-Friedl et al. ..... 378/154

* cited by examiner

*Primary Examiner*—Allen C. Ho
(74) *Attorney, Agent, or Firm*—Carl B. Horton, Esq.; Armstrong Teasdale LLP

(57) ABSTRACT

A method for fabricating a collimator includes mixing an x-ray absorbent material with at least one of a temporary binder and a temporary gel, and extruding the mixed x-ray absorbent material through a die to form a unitary collimator structure that is at least one of substantially honeycomb in shape and substantially rectangular in shape.

19 Claims, 4 Drawing Sheets

COLLIMATOR FOR IMAGING SYSTEMS AND METHODS FOR MAKING SAME

BACKGROUND OF THE INVENTION

This invention relates generally to methods for making a collimator used in an imaging system, and to the collimator made from these methods.

In at least one known CT system configuration, an x-ray source projects a fan-shaped beam which is collimated to lie within an X-Y plane of a Cartesian coordinate system and generally referred to as the "imaging plane". The x-ray beam passes through the object being imaged, such as a patient. The beam, after being attenuated by the object, impinges upon an array of radiation detectors. The intensity of the attenuated beam radiation received at the detector array is dependent upon the attenuation of the x-ray beam by the object. Each detector element of the array produces a separate electrical signal that is a measurement of the beam attenuation at the detector location. The attenuation measurements from all the detectors are acquired separately to produce a transmission profile of the object.

In known third generation CT systems, the x-ray source and the detector array are rotated with a gantry within the imaging plane and around the object to be imaged so that the angle at which the x-ray beam intersects the object constantly changes. A group of x-ray attenuation measurements, i.e., projection data, from the detector array at one gantry angle is referred to as a "view". A "scan" of the object comprises a set of views made at different gantry angles during one revolution of the x-ray source and detector. In an axial scan, the projection data is processed to construct an image that corresponds to a two dimensional slice taken through the object.

One method for reconstructing an image from a set of projection data is referred to in the art as the filtered backprojection technique. This process converts the attenuation measurements from a scan into integers called "CT numbers" or "Hounsfield units", which are used to control the brightness of a corresponding pixel on a cathode ray tube display.

Detector elements are configured to perform optimally when impinged by x-rays travelling a straight path from the x-ray source to the detector elements. Particularly, detector elements typically include scintillation crystals which generate light events when impinged by an x-ray beam. These light events are output from each detector element and directed to photoelectrically responsive materials in order to produce an electrical signal representative of the attenuated beam radiation received at the detector element. Typically, the light events are output to photomultipliers or photodiodes which produce individual analog outputs. Detector elements thus output a strong signal in response to impact by a straight path x-ray beam.

X-rays often scatter when passing through the object being imaged. Particularly, the object often causes some, but not all, x-rays to deviate from the straight path between the x-ray source and the detector. Therefore, detector elements are often impinged by x-ray beams at varying angles. System performance is degraded when detector elements are impinged by these scattered x-rays. When a detector element is subjected to multiple x-rays at varying angles, the scintillation crystal generates multiple light events. The light events corresponding to the scattered x-rays generate noise in the scintillation crystal output, and thus cause artifacts in the resulting image of the object.

To reduce the effects of scattered x-rays, scatter collimators are often disposed between the object of interest and the detector array. Such collimators are constructed of x-ray absorbent material and positioned so that scattered x-rays are substantially absorbed before impinging upon the detector array. For one known collimator, it is important that the scatter collimator be properly aligned with both the x-ray source and the detector elements so that only x-rays travelling on a substantially straight path impinge on the detector elements.

Known collimators are complicated and cumbersome to construct. In addition, it is difficult to satisfactorily align known collimators with the x-ray source and the detector elements to both absorb scattered x-rays and shield sensitive portions of the detector elements.

BRIEF SUMMARY OF THE INVENTION

In one embodiment, a method for fabricating a collimator is provided. The method includes mixing an x-ray absorbent material with at least one of a temporary binder and a temporary gel, and extruding the mixed x-ray absorbent material through a die to form a unitary collimator structure that is at least one of substantially honeycomb in shape and substantially rectangular in shape.

In another embodiment, a collimator for an imaging system is provided. The collimator includes an extruded x-ray absorbent material, and is unitary and at least one of substantially honeycomb in shape and substantially rectangular in shape.

In a further embodiment, a computed tomographic (CT) imaging is provided. The CT system includes a detector array, at least one radiation source, and a collimator including an extruded x-ray absorbent material wherein the collimator is unitary and at least one of substantially honeycomb in shape and substantially rectangular in shape.

DETAILED DESCRIPTION OF THE INVENTION

Figure 1:
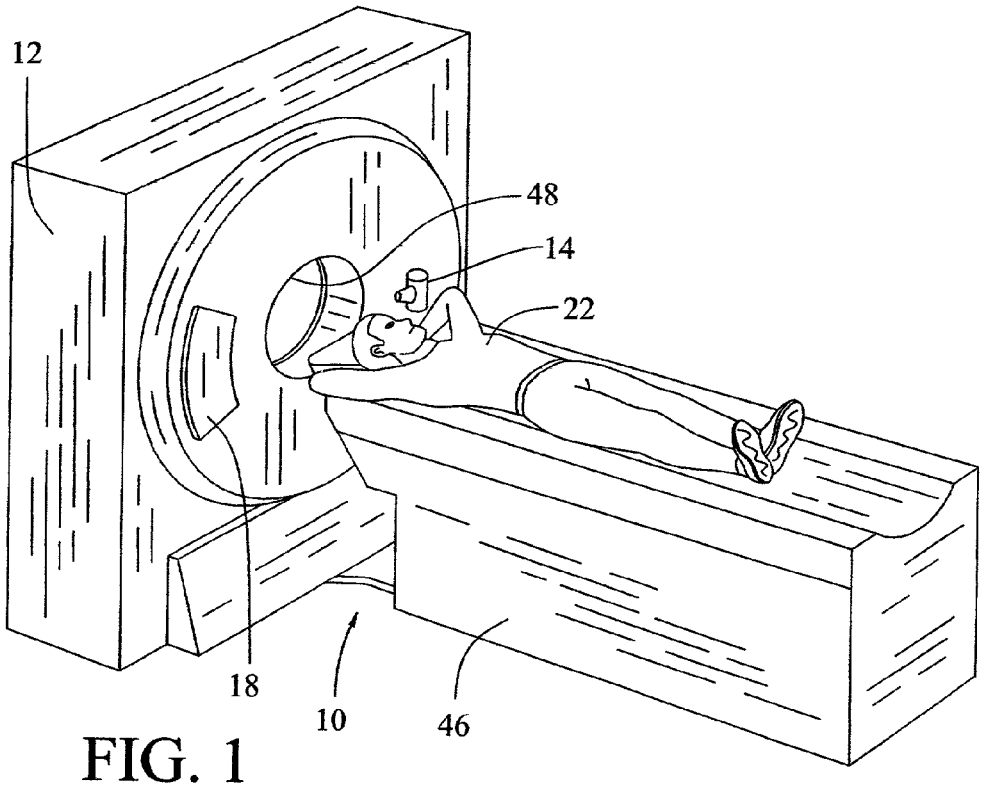
FIG. 1 is a pictorial view of a CT imaging system.
Figure 2:
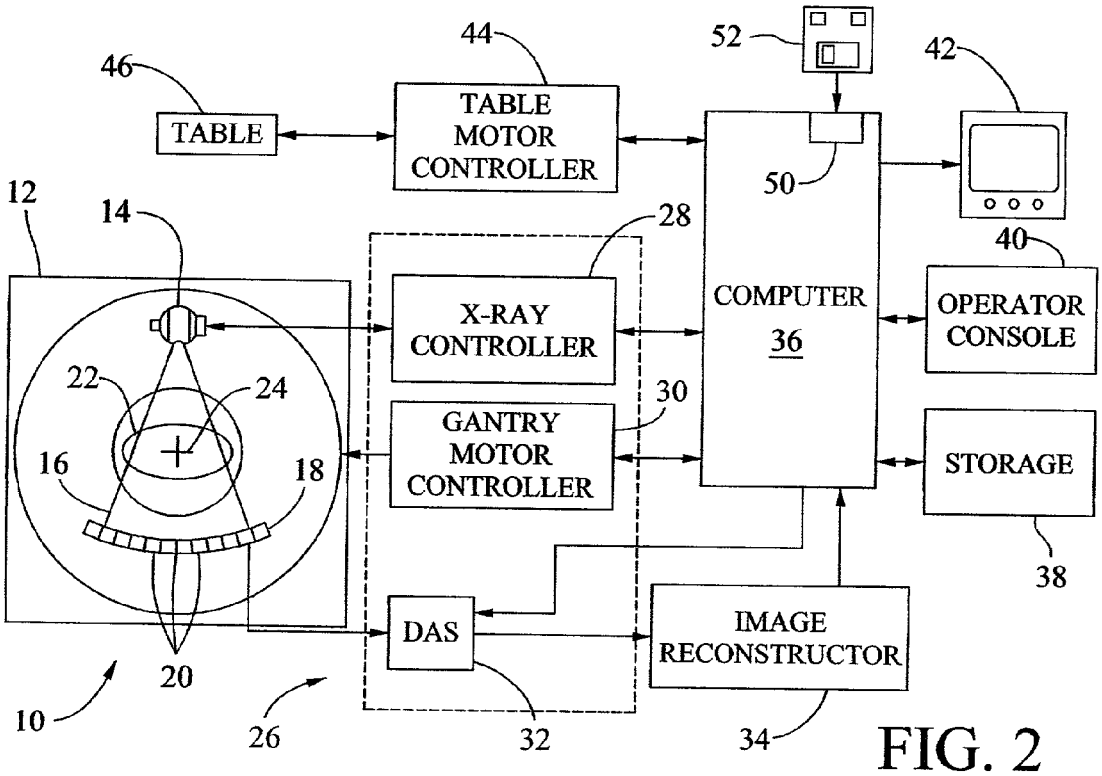
FIG. 2 is a block schematic diagram of the system illustrated in FIG. 1.

Referring to FIGS. 1 and 2, a computed tomograph (CT) imaging system 10 is shown as including a gantry 12 representative of a "third generation" CT scanner. Gantry 12 has an x-ray source 14 that projects a beam of x-rays 16 toward a radiation detector array 18 on the opposite side of gantry 12. Detector array 18 is formed from a plurality of detector elements 20 including a plurality of scintillators (not shown), which together sense the projected x-rays that pass through an object 22, for example a medical patient. Detector array 18 may be fabricated in a single slice or multi-slice configuration. Each detector element 20 produces light in response to x-ray radiation, which is converted to an electrical signal by a sensing region of a semiconductor array optically coupled thereto. Each detector element 20 produces an electrical signal that represents the intensity of an impinging x-ray beam on that detector element and hence the attenuation of the beam as it passes through patient 22 at a corresponding angle. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to x-ray source 14 and a gantry motor controller 30 that controls the rotational speed and position of gantry 12. A data acquisition system (DAS) 32 in control mechanism 26 samples analog data from detector elements 20 and converts the data to digital signals for subsequent processing. An image reconstructor 34 receives sampled and digitized x-ray data from DAS 32 and performs high speed image reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 in gantry 12. Particularly, table 46 moves portions of patient 22 through gantry opening 48.

In one embodiment, computer 36 includes a device 50, for example, a floppy disk drive or CD-ROM drive, for reading instructions and/or data from a computer-readable medium 52, such as a floppy disk or CD-ROM. In another embodiment, computer 36 executes instructions stored in firmware (not shown). Computer 36 is programmed to perform functions described herein, accordingly, as used herein, the term computer is not limited to just those integrated circuits referred to in the art as computers, but broadly refers to computers, processors, microcontrollers, microcomputers, programmable logic controllers, application specific integrated circuits, and other programmable circuits.

Figure 3:
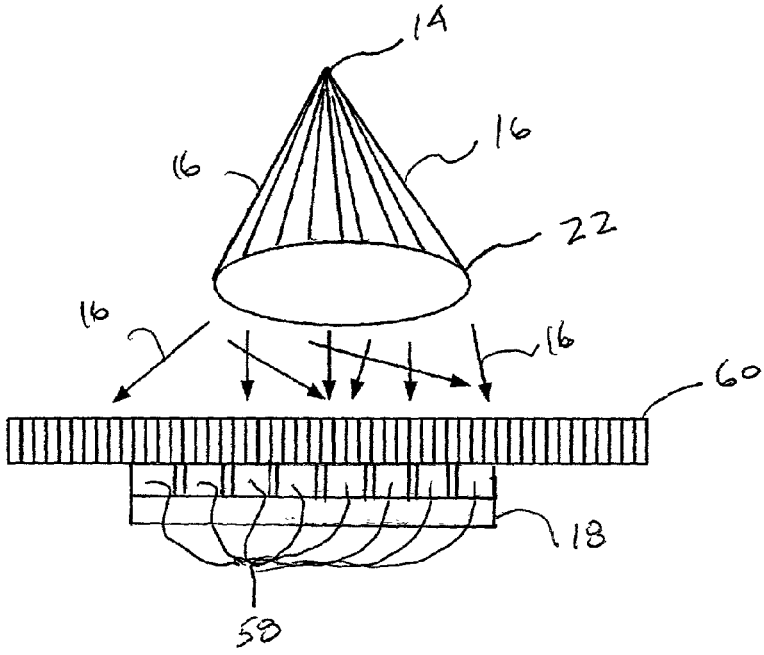
FIG. 3 is a side view of a detector array including a plurality of scintillator elements and a collimator positioned proximate to the scintillator elements.
Figure 4:
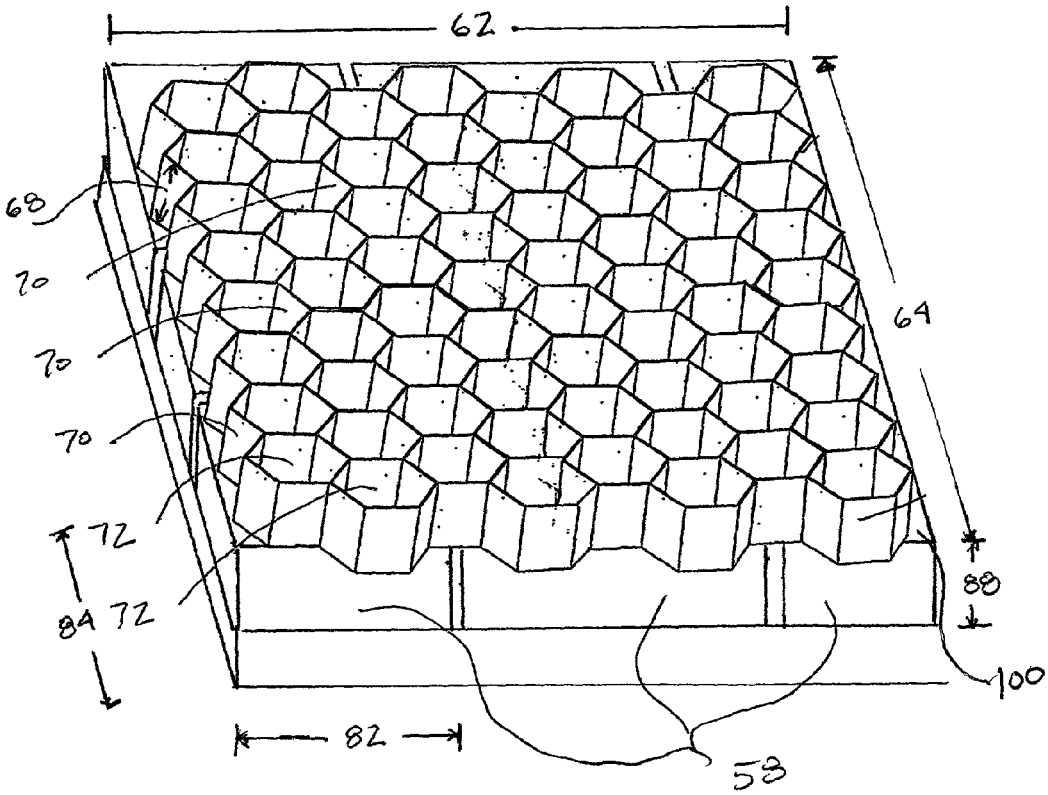
FIG. 4 is a perspective view of the collimator and scintillator elements shown in FIG. 3.
Figure 5:
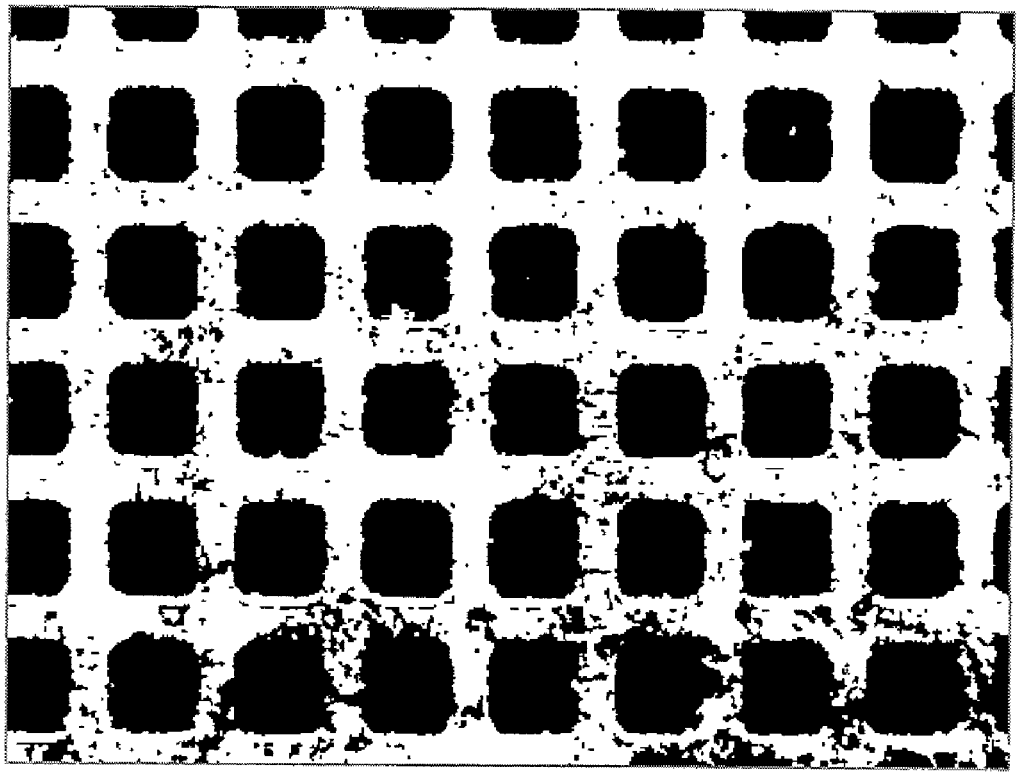
FIG. 5 is a perspective view of another embodiment of the collimator shown in FIG. 3.

FIG. 3 is a side view of detector array 18 including a plurality of scintillator elements 58, and a collimator 60 positioned proximate to scintillator elements 58 such that x-rays 16 pass through object 22, and collimator 60 before impinging on detector array 18. FIG. 4 is a perspective view of an exemplary collimator 60 positioned proximate scintillator elements 58. FIG. 5 is a perspective view of another exemplary collimator shown in FIG. 3. In the exemplary embodiment, collimator 60 includes a length 62 and a width 64 that defines a collimator area, and a thickness 68. Collimator 60 also includes a plurality of sidewalls 70 surrounding a plurality of openings 72. In one embodiment, sidewalls 70 are formed such that openings 72 define a substantially honeycomb shape (i.e. a plurality of interconnected hexagons). In another embodiment, sidewalls 70 are formed such that openings 72 form a shape that is substantially rectangular in shape. Each scintillator element 58 includes a length 82 and a width 84 that defines a scintillator area, and a thickness 88. In the exemplary embodiment, the scintillator area is substantially greater than a single collimator opening 72 such that a random distribution of collimator openings 72 are positioned proximate scintillator elements 58 and such that at least two partial openings 72 are positioned proximate a single scintillator element 58. For example, a single scintillator element 58 may have a single opening 72 and several partial openings or a single scintillator element 58 may have a plurality of openings 72 and a plurality of partial openings 72 proximate each scintillator element 58.

Figure 6:
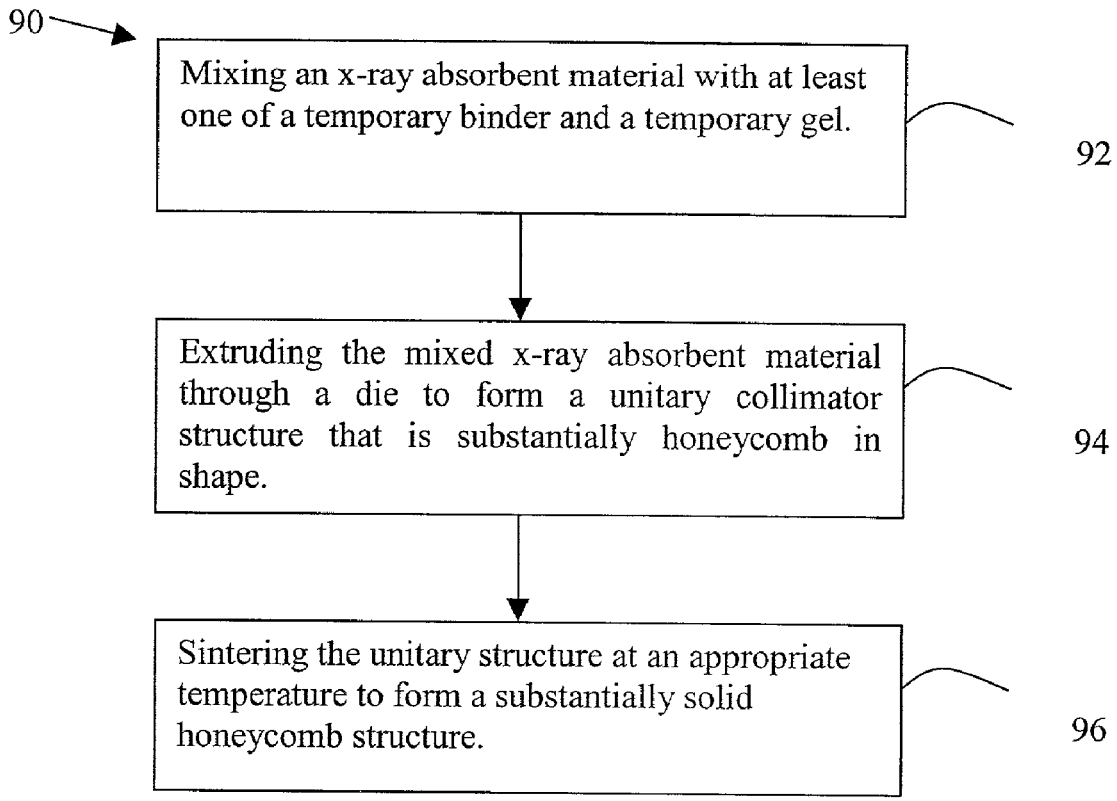
FIG. 6 is a flow chart illustrating an exemplary method for fabricating a collimator.

FIG. 6 is a method 90 for fabricating collimator 60. Method 90 includes mixing 92 an x-ray absorbent material with at least one of a temporary binder or a temporary gel. In one embodiment, the x-ray absorbent material includes a metallic material having a high atomic weight (Z number). In one embodiment, the metallic material has a Z number greater than seventy-two such as, but not limited to, tungsten, tantalum, and lead. Suitable organic binders include organic binders or gels used in ceramic molding, such as polyethylene glycol, methylcellulose, ethylhydroxy ethylcellulose, hydroxybutyl methylcellulose, hydroxymethylcellulose, hydroxypropyl methylcellulose, hydroxyethyl methylcellulose, hydroxybutylcellulose, hydroxyethyl-cellulose, hydroxypropylcellulose, sodium carboxy methylcellulose, and mixtures thereof. The collimator is partially solidified or dried to make a flexible "cake". Method 90 also includes extruding 94 the mixed x-ray absorbent material through a die to form a unitary collimator structure that is substantially honeycomb in shape or substantially rectangular in shape, and sintering 96 the unitary structure at an appropriate temperature to form a substantially solid honeycomb structure. The substantially solid honeycomb structure is then sliced to a length dependent upon the embodiment to form collimator 60.

In use, collimator 60 is positioned proximate a scintillator x-ray incidence side 100 (shown in FIG. 4) such that x-rays 16 pass through object 22 and collimator 60 before impinging on scintillator elements 58. Scattered x-rays passing through object 22 are substantially reduced using collimator 60 prior to being sensed by detector 18. In the exemplary embodiment, collimator 60 is mechanically attached to detector 18 using at least one mechanical fastener (not shown).

In the exemplary embodiment, collimator 60 is positioned to form a series of high aspect ratio channels proximate each scintillator element 58 to facilitate attenuating scattered x-rays. Additionally, the accuracy of openings 72 can be reduced since a specific collimator opening 72 is not aligned with a specific scintillator element 58, but rather openings 72 form a random distribution of collimating openings proximate the scintillator array. Collimator 60 also facilitates reducing an aspect ratio since collimation is accomplished in two directions.

The above-described collimator provides for alignment with both the focal spot and the detector elements without the collimator being precisely aligned between the detector and the radiation source. Also, the collimator is not complex, and is more simple to fabricate than some known collimators. In addition, the scatter collimator sufficiently shields the detector elements from undesirable scattered x-rays and other radiation, thereby facilitating a reduction in x-rays, that are not travelling on a substantially straight path, from impinging on the detector elements and thus reducing artifacts in the resulting image of the object. Accordingly, the herein described collimator is believed to provide improved system performance as compared to known collimators.

While the invention has been described in terms of various specific embodiments, those skilled in the art will recognize that the invention can be practiced with modification within the spirit and scope of the claims.

What is claimed is:

1. A method for fabricating a collimator, said method comprising:

mixing an x-ray absorbent material with at least one of a temporary binder and a temporary gel;

extruding the mixed x-ray absorbent material through a die to form a unitary collimator structure that is at least one of substantially honeycomb in shape and substantially rectangular in shape;

slicing the unitary structure to form a collimator having collimating openings; and positioning the collimator proximate a scintillator array such that a random distribution of collimating openings are positioned proximate the scintillator array.

2. A method in accordance with claim 1 further comprising:

sintering the unitary structure at an appropriate temperature.

3. A method in accordance with claim 1 wherein said mixing an x-ray absorbent material includes mixing an x-ray absorbent material having an atomic number greater than 72.

4. A method in accordance with claim 1 wherein said mixing an x-ray absorbent material includes mixing an x-ray absorbent material including at least one of tantalum, lead, and tungsten.

5. A method in accordance with claim 1 wherein the random distribution of collimating openings includes at least two collimating openings positioned proximate a single scintillator element.

6. A method in accordance with claim 1 wherein the binder comprises at least one of polyethylene glycol, methylcellulose, ethyihydroxy ethylcellulose, hydroxybutyl methylcellulose, hydroxymethylcellulose, hydroxypropyl methylcellulose, hydroxyethyl methylcellulose, hydroxybutylcellulose, hydroxyethyl-cellulose, hydroxypropylcellulose, and sodium carboxy methylcellulose.

7. A collimator/scintillator array assembly for an imaging system, said collimator/scintillator array assembly comprising a unitary collimator, said collimator comprising an extruded x-ray absorbent material, a binder and a plurality of openings that are at least one of substantially honeycomb in shape and substantially rectangular in shape; and a scintillator array comprising a plurality of scintillators each having a scintillator area and an x-ray incidence side, wherein said collimator positioned proximate said x-ray incidence side and an area of a single said scintillator of said plurality of scintillators is greater than a single said collimator opening and at least two partial said openings are positioned proximate a single scintillator.

8. A collimator/scintillator array assembly in accordance with claim 7 wherein said extruded x-ray absorbent material comprises a sintered x-ray absorbent material.

9. A collimator/scintillator array assembly in accordance with claim 7 wherein said extruded x-ray absorbent material comprises at least one of tantalum, lead, and tungsten.

10. A collimator in accordance with claim 7 wherein said binder comprises at least one of polyethylene glycol, methylcellulose, ethylhydroxy ethylcellulose, hydroxybutyl methylcellulose, hydroxymethylcellulose, hydroxypropyl methylcellulose, hydroxyethyl methylcellulose, hydroxybutylcellulose, hydroxyethyl-cellulose, hydroxypropylcellulose, and sodium carboxy methylcellulose.

11. A computed tomographic (CT) imaging system, said CT system comprising:

at least one radiation source; and a collimator comprising an extruded x-ray absorbent material wherein said collimator is unitary and comprises a binder and a plurality of openings that are at least one of substantially honeycomb in shape and substantially rectangular in shape; and a scintillator array comprising a plurality of scintillators each having a scintillator area and an x-ray incidence side, wherein said collimator positioned proximate said x-ray incidence side, an area of a single said scintillator of said plurality of scintillators is greater than a single said collimator opening and at least two partial said openings are positioned proximate a single scintillator.

12. A CT imaging system in accordance with claim 11 wherein said extruded x-ray absorbent material comprises a sintered x-ray absorbent material.

13. A CT imaging system in accordance with claim 11 wherein said extruded x-ray absorbent material comprises an x-ray absorbent material comprising an atomic number greater than 72.

14. A CT imaging system in accordance with claim 11 wherein said extruded x-ray absorbent material comprises at least one of tantalum, lead, and tungsten.

15. A CT imaging system in accordance with claim 11 wherein said collimator comprises a random distribution of collimating openings positioned proximate a scintillator array.

16. A CT imaging system in accordance with claim 11 wherein said binder comprises at least one of polyethylene glycol, methylcellulose, ethyihydroxy ethylcellulose, hydroxybutyl methylcellulose, hydroxymethylcellulose, hydroxypropyl methylcellulose, hydroxyethyl methylcellulose, hydroxybutylcellulose, hydroxyethylcellulose, hydroxypropylcellulose, and sodium carboxy methylcellulose.

17. A computed tomographic (CT) imaging system, said CT system comprising:

a gantry;

a detector array on the gantry, said detector array including a scintillator array comprising a plurality of scintillators each having a scintillator area and an x-ray incidence side;

at least one x-ray source on the gantry configured to project a beam of x-radiation towards said detector array through an object to be imaged; and an extruded unitary collimator positioned proximate said x-ray incidence side, said collimator comprising an x-ray absorbent material having an atomic number greater than 72, said collimator further comprising a random distribution of collimator openings configured such that at least two partial openings are positioned proximate a single scintillator, and wherein an area of a single said scintillator of said plurality of scintillators is greater than a single said collimator opening.

18. A method for fabricating a collimator, said method comprising:

mixing an x-ray absorbent material with at least one of a temporary binder and a temporary gel;

extruding the mixed x-ray absorbent material through a die to form a unitary collimator structure that includes a plurality of collimating openings wherein the collimating openings are at least one of substantially honeycomb in shape and substantially rectangular in shape; and positioning the collimator proximate a scintillator array having single scintillators that have a larger area than single said collimating openings such that a random distribution of collimating openings are positioned proximate the scintillator array and at least two partial collimating openings are positioned proximate a single scintillator.

19. A method for fabricating a collimator, said method comprising:

mixing an x-ray absorbent material including an atomic number greater than 72 with at least one temporary binder and at least one temporary gel;

extruding the mixed x-ray absorbent material through a die to form a unitary structure that comprises a plurality of collimating openings that are at least one of substantially honeycomb in shape and substantially rectangular in shape;

sintering the unitary structure at an appropriate temperature;

slicing the unitary structure to form a collimator; and positioning the collimator proximate a scintillator array having single scintillators larger than single said collimating openings such that a random distribution of collimating openings are positioned proximate the scintillator array and at least two partial collimating openings are positioned proximate a single scintillator.

* * * * *

UNITED STATES PATENT AND TRADEMARK OFFICE

CERTIFICATE OF CORRECTION

PATENT NO. : 6,993,110 B2
APPLICATION NO. : 10/132833
DATED : January 31, 2006
INVENTOR(S) : Hoffman It is certified that error appears in the above-identified patent and that said Letters Patent is hereby corrected as shown below:

In Claim 6, column 5, line 32, delete "ethyihydroxy" and insert therefor --ethylhydroxy--.
In Claim 16, column 6, line 32, delete "ethyihydroxy" and insert therefor --ethylhydroxy--.

Signed and Sealed this

Eleventh Day of March, 2008

JON W. DUDAS
*Director of the United States Patent and Trademark Office*